US007744486B2

(12) United States Patent
Hou et al.

(10) Patent No.: US 7,744,486 B2
(45) Date of Patent: Jun. 29, 2010

(54) GOLF CLUB HEAD

(75) Inventors: Wen-Ching Hou, Kaohsiung (TW); Chan-Tung Chen, Kaohsiung (TW); Chun-Yung Huang, Daliaoshiang (TW)

(73) Assignees: Nelson Precision Casting Co., Ltd., Kaohsiung (TW); Fu Sheng Industrial Co., Ltd., Taipei (TW)

( * ) Notice: Subject to any disclaimer, the term of this patent is extended or adjusted under 35 U.S.C. 154(b) by 125 days.

(21) Appl. No.: 12/057,860

(22) Filed: Mar. 28, 2008

(65) Prior Publication Data

US 2009/0191979 A1 Jul. 30, 2009

(30) Foreign Application Priority Data

Jan. 28, 2008 (CN) ..... 2008 1 0007000

(51) Int. Cl.
*A63B 53/04* (2006.01)

(52) U.S. Cl. ..... 473/329; 473/332; 473/345; 473/349; 473/350

(58) Field of Classification Search ..... 473/324–350, 473/287–292
See application file for complete search history.

(56) References Cited

U.S. PATENT DOCUMENTS 4,749,197 A * 6/1988 Orlowski ..... 473/342
5,244,211 A * 9/1993 Lukasiewicz ..... 473/305
5,766,092 A * 6/1998 Mimeur et al. ..... 473/329
5,899,821 A * 5/1999 Hsu et al. ..... 473/332
6,379,262 B1 * 4/2002 Boone ..... 473/324
6,398,666 B1 * 6/2002 Evans et al. ..... 473/345
6,896,627 B2 * 5/2005 Hou ..... 473/335
6,921,343 B2 * 7/2005 Solheim ..... 473/329
6,932,717 B2 * 8/2005 Hou et al. ..... 473/332
7,070,513 B2 * 7/2006 Takeda et al. ..... 473/329
7,125,343 B2 * 10/2006 Imamoto ..... 473/332
7,182,698 B2 * 2/2007 Tseng ..... 473/332
2002/0082117 A1 * 6/2002 Nishitani et al. ..... 473/345
2003/0083148 A1 * 5/2003 Willett et al. ..... 473/329
2005/0192116 A1 * 9/2005 Imamoto ..... 473/329
2007/0149314 A1 * 6/2007 Ban ..... 473/332

* cited by examiner

*Primary Examiner*—Sebastiano Passaniti
(74) *Attorney, Agent, or Firm*—Muncy, Geissler, Olds & Lowe, PLLC

(57) ABSTRACT

A golf club head is disclosed. The golf club head comprises a main body, a striking plate and a thermoplastic elastic vibration-absorbing material. The main body includes a chamber. The striking plate is disposed on the front side of the main body. The thickness of the striking plate is between 0.76 mm and 2.25 mm. The thermoplastic elastic shock absorber is formed in the chamber of the main body and touches the back of the striking plate, wherein the density of the thermoplastic elastic vibration-absorbing material is between 0.5 g/cm$^3$ and 1.3 g/cm$^3$.

20 Claims, 7 Drawing Sheets

GOLF CLUB HEAD

RELATED APPLICATIONS

This application claims priority to China Application Serial Number 200810007000.9, filed Jan. 28, 2008, which is herein incorporated by reference.

FIELD OF THE INVENTION

This invention relates to a golf club head, and more particularly, to golf club head with a thinner striking plate.

BACKGROUND OF THE INVENTION

Current golf club heads may use a material with great coefficient of restitution (COR) to form the main body for better striking effect, thereby raising the striking distance. When striking the golf club ball with the golf club head, the striking plate thereof can apply the striking force to the golf ball. However, according to dynamic theory, a simultaneous reacting force (i.e. striking stress) is affected on the striking plate that may cause vibrations and shocks on the golf club. Although most of the striking stress or impact energy is absorbed or reduced by the structure of the golf club, the unabsorbed impact energy may be transmitted through the shaft to the handle. This causes an uncomfortable condition in user's hand when striking, and even damages the structural strength of the golf club.

Further, in the dynamic analysis, to improve striking accuracy and direction controllability of the golf ball, when the golf ball begins to make contact with the striking plate, the striking plate should be rapidly and significantly compressed when subjected to a slight striking stress, and the striking plate should rapidly resume its shape, thereby creating a greater restoring force to be fed to the golf ball. Therefore, the golf club head is deformed when striking the golf ball. Furthermore, to enhance the vibration-absorbing effect of the golf club head, the striking plate must be thicker, such as 2.3 mm, and thus consume more striking plate material and increase the weight thereof.

SUMMARY OF THE INVENTION

Therefore, an aspect of the present invention is to provide a golf club head to enhance the vibration-absorbing effect thereof and reduce the thickness of the striking plate.

According to an embodiment of the present invention, the golf club head comprises a main body, striking plate and a thermoplastic elastic vibration-absorbing material. The main body includes a chamber. The striking plate is disposed on the front side of the main body, wherein the chamber of is connected to the rear side of the striking plate, and the thickness of the striking plate is substantially between 0.76 mm and 2.25 mm. The thermoplastic elastic vibration-absorbing material is formed in the chamber of the main body and touches the rear side of the striking plate, wherein the density of the thermoplastic elastic vibration-absorbing material is substantially between 0.5 g/cm$^3$ and 1.3 a/cm$^3$, and wherein the characteristic time the golf club head is in contact with the golf ball is substantially less than 257 micro-seconds.

Therefore, with the application of the golf club head disclosed in the embodiments of the present invention, the vibration-absorbing effect can be improved, and the thickness of the striking plate can be reduced.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

In order to make the illustration of the present invention more explicit and complete, the following description is stated with reference to FIG. 1 through FIG. 7.

Figure 1:
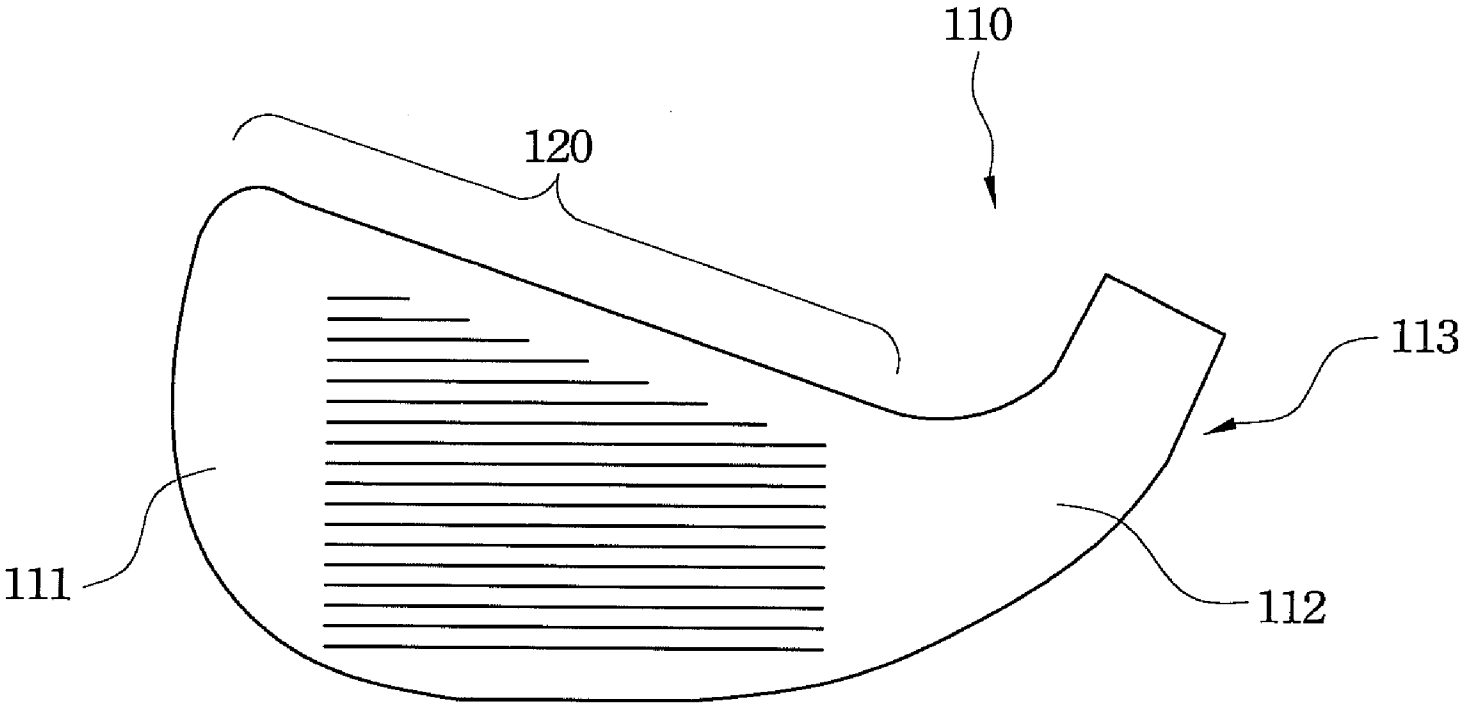
FIG. 1 is face view showing a golf club head according to a first embodiment of the present invention.
Figure 2:
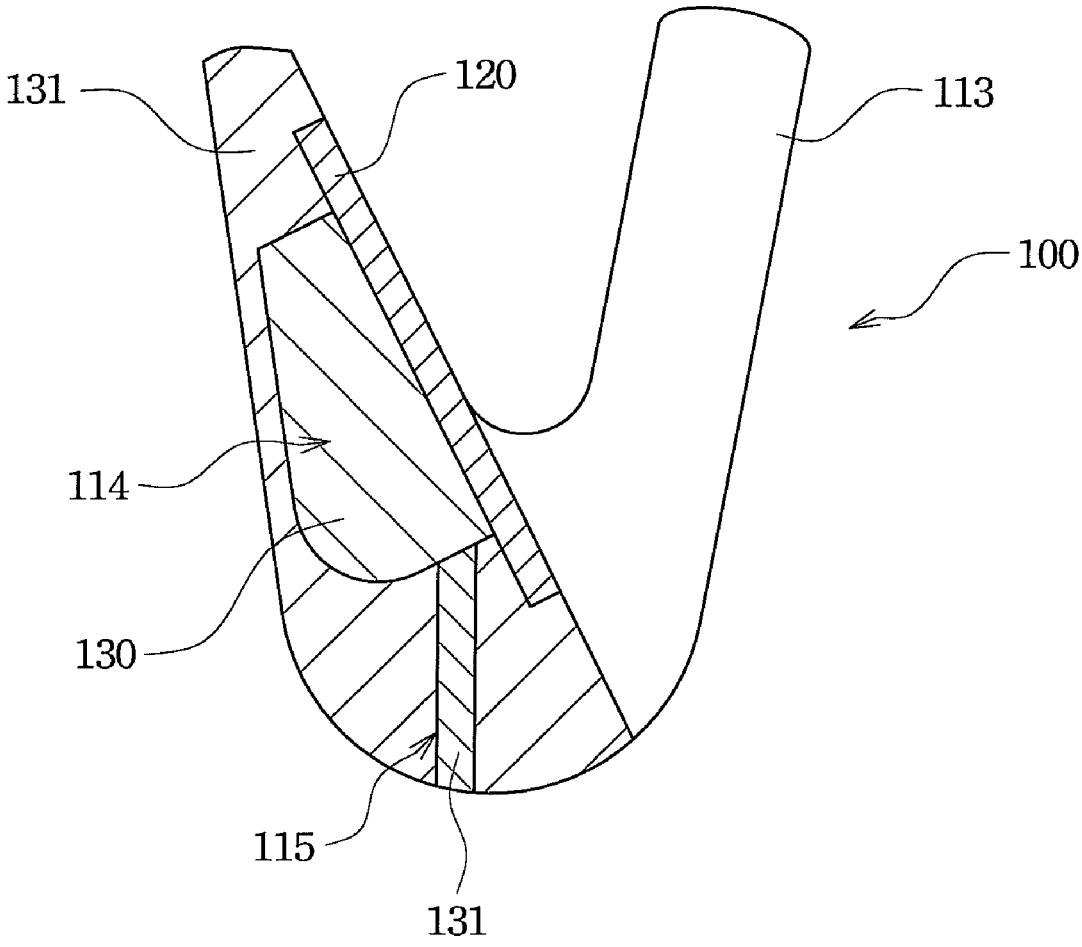
FIG. 2 is a cross-sectional diagram showing a golf club head according to a first embodiment of the present invention.

Refer to FIG. 1 and FIG. 2. FIG. 1 is face view showing a golf club head according to a first embodiment of the present invention. FIG. 2 is a cross-sectional diagram showing a golf club head according to a first embodiment of the present invention. The golf club head 100 of the present embodiment comprises a main body 110, a striking plate 120 and a thermoplastic elastic vibration-absorbing material 130. The striking plate 120 is disposed on the front side of the main body 110 for striking the golf ball (not shown). The thermoplastic elastic vibration-absorbing material 130 is formed in the main body 110 to absorb vibrations, thereby absorbing the vibration and shock thereon and creating a comfortable condition in user's hand when striking. Further, the characteristic time the golf club head 100 is in contact with the golf ball is substantially less than 257 micro-seconds.

Refer to FIG. 1 and FIG. 2 again. The material of the main body 110 of present embodiment may be carbon steel (such as S20 or 8620 carbon steel), stainless steel (such as 303, 316 or 17-4PH stainless steel), alloy steel, Fe—Mn—Al alloy, Ni-based alloy, cast iron, titanium alloy (such as CPTi or Ti6Al4V alloy), aluminum alloy, Al—Mg alloy, tungsten alloy, copper alloy, ceramics, carbon fiber, plastics or any composition thereof. The main body 110 may be made to form one-piece using a method such as casting, precision casting, die-casting, forging or machining, or assembling the segments thereof to form the one-piece. The main body 110 includes a toe portion 111, a heel portion 112 and a hosel 113, a chamber 114 and an injection hole 115. The toe portion 111 and the heel portion 112 are respectively located at both ends of the main body 110. The hosel 113 extends out one side of the main body 110 and is close to the heel portion 112 to receive a club shaft (not shown). The chamber is formed in the main body 110 to receive the thermoplastic elastic vibration-absorbing material 130 to absorb vibrations. The chamber 114 may be formed at the rear side and the bottom of the main body 110, and preferably correspond to the main striking area (i.e. the sweet spot) of the striking plate or the vibration concentration area, such as the toe portion 111 and the heel portion 112. The injection hole 115 may be the through hole connected to the chamber 114. In the present embodiment, the injection hole 115 is formed at the bottom of the main body 110. However, the present invention does not limit the position of the injection hole 115. The injection hole 115 is formed at the top portion, the rear side, the toe portion 111 or the heel portion 112 of the main body 110.

Refer to FIG. 1 and FIG. 2 again. The striking plate 120 of this embodiment is bonded to the front side of the main body 110 by such as a method of inserting, press bonding, brazing, welding or screwing for striking the golf ball. The material of the striking plate 120 may be carbon steel, stainless steel (such as 17-4PH stainless steel), Fe—Mn—Al alloy, titanium alloy (such as CPTi or Ti6Al4V alloy) aluminum alloy, copper alloy, ceramics, carbon fiber, plastics or any composition thereof, and preferably the material with high coefficient of restitution (COR) or high hardness. The hardness of the striking plate 120 (such as titanium alloy) is preferably higher than the hardness of the main body 110 (such as stainless steel), thereby improving the striking efficacy and distance of the golf club head 100. Further, the striking plate 120 of the present embodiment can be a thin type striking plate with uniform or various thickness, wherein the thickness thereof is substantially between 0.76 mm and 2.25 mm.

Figure 3:
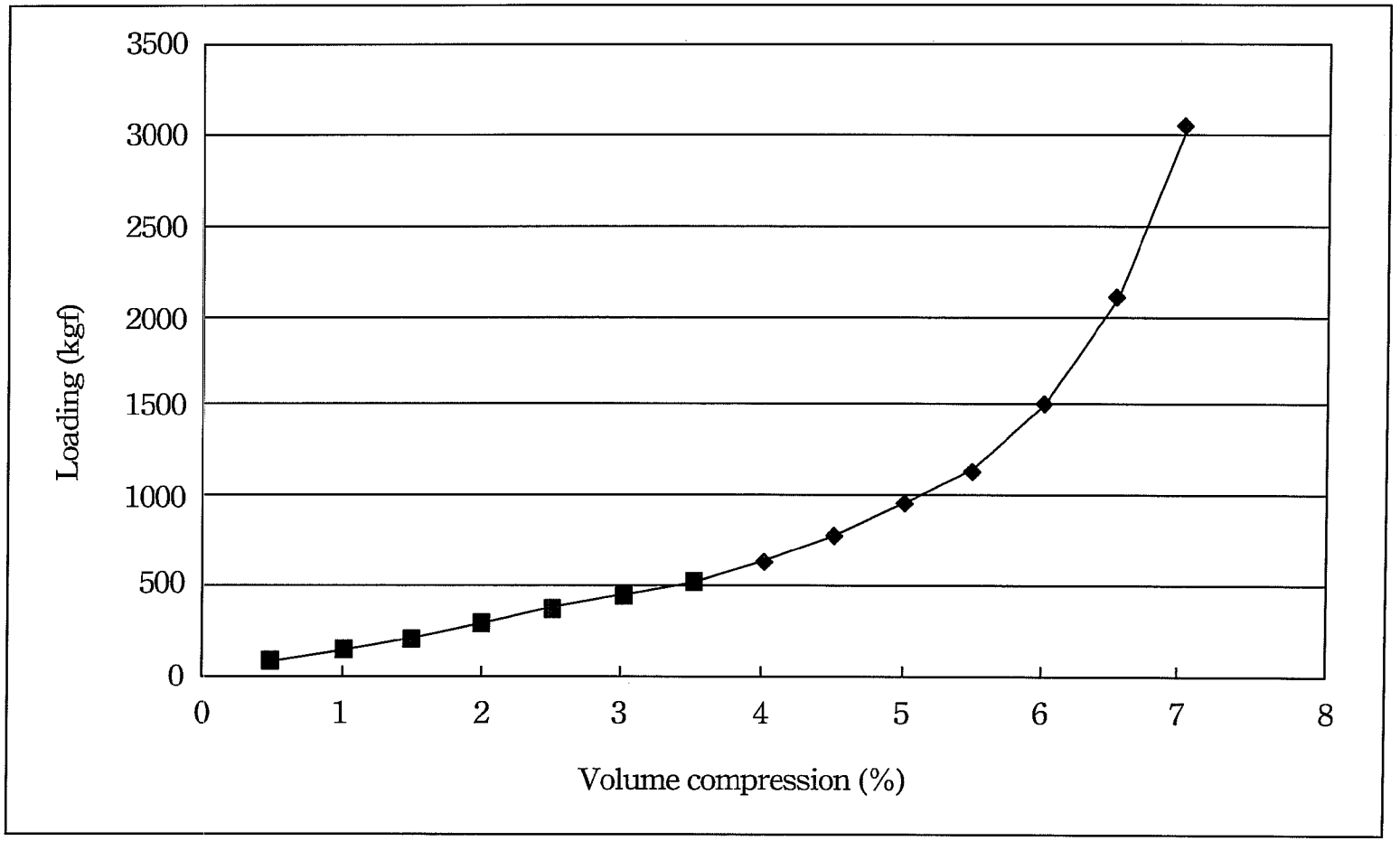
FIG. 3 is a chart showing the relationship between the loading and the volume compression ratio of a thermoplastic elastic vibration-absorbing material according to a first embodiment of the present invention.

Refer to FIG. 1 through FIG. 3. FIG. 3 is a chart showing the relationship between the loading and the volume compression ratio of a thermoplastic elastic vibration-absorbing material according to a first embodiment of the present invention. The thermoplastic elastic vibration-absorbing material 130 of the present embodiment is formed in the chamber 114 of the main body by a method such as of injection molding or hot embossing, and touches the rear side of the striking plate 120 to absorb vibrations. The thermoplastic elastic vibration-absorbing material 130 is a thermoplastic elastic material, such as SIS, SBS, SEBS, TPE, TPR, TPU, TPV, TPO or TPEE, and the density thereof is substantially between 0.5 $g/cm^3$ and 1.3 $g/cm^3$, and the flexural modulus thereof is substantially between 2.07 MPa and 339 MPa, and the tensile strength thereof is substantially between 0.17 MPa and 52.7 MPa, and the tensile elongation thereof is substantially between 2.9% and 810%. When forming the thermoplastic elastic vibration-absorbing material 130 in the chamber 114 of the main body 110, the thermoplastic elastic vibration-absorbing material 130 can be preheated, and then can be injected into the chamber 114 through the injection hole 115, thereby forming the thermoplastic elastic vibration-absorbing material 130. After forming the thermoplastic elastic vibration-absorbing material 130, a sealing element 131 seals the injection hole 115. The sealing element 131 may be a plug, or can be formed as one piece together with the thermoplastic elastic vibration-absorbing material 130. It is worth mentioning that the volume compression ratio of the thermoplastic elastic vibration-absorbing material 130 formed in the chamber 114 of the main body 110 is substantially less than 7%, and preferably substantially between 3.5% and 7%.

Figure 4:
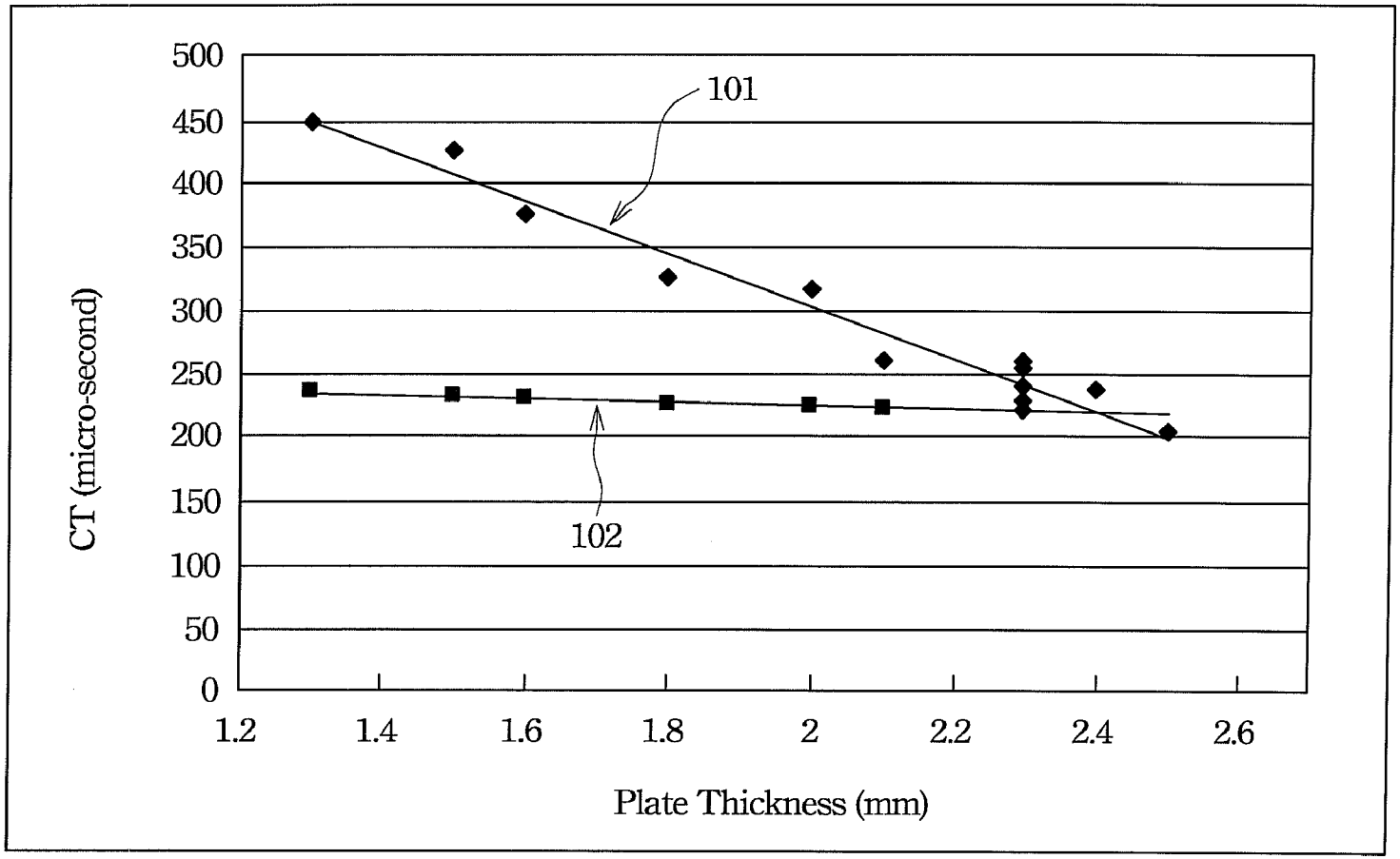
FIG. 4 is a chart showing the relationship between the thickness of a striking plate and the characteristic time of a golf club head according to a first embodiment of the present invention.

Refer to FIG. 4. FIG. 4 is a chart showing the relationship between the thickness of a striking plate and the characteristic time of a golf club head according to a first embodiment of the present invention. For example, when the thermoplastic elastic vibration-absorbing material 130 is such as TPE, a line 101 illustrates the relationship between the thickness of the striking plate and the characteristic time of the golf club head 100 without the thermoplastic elastic vibration-absorbing material 130. The line 101 can be expressed as:

$$y_1=-204.58x_1+712.88 \quad \text{[Eq. 1]}$$

Wherein $x_1$ and $y_1$ are respectively the thickness of the striking plate and the characteristic time the golf club head 100 is in contact with the golf ball without the thermoplastic elastic vibration-absorbing material 130.

A line 102 illustrates the relationship between the thickness of the striking plate and the characteristic time of the golf club head 100 with the thermoplastic elastic vibration-absorbing material 130. The line 102 can be expressed as:

$$y_2=-16.6x_2+256.58 \quad \text{[Eq. 2]}$$

Wherein $x_2$ and $y_2$ are respectively the thickness of the striking plate and the characteristic time of the golf club head 100 with the thermoplastic elastic vibration-absorbing material 130.

From the lines 101 and 102, when the golf club head 100 does not have the thermoplastic elastic vibration-absorbing material 130, the thickness of the striking plate 120 has to be increased to greater than 2.3 mm to reduce the characteristic time thereof to less than 239 micro-seconds. However, when the golf club head 100 has the thermoplastic elastic vibration-absorbing material 130, the characteristic time thereof can be less than −204.58x+712.88, wherein x is the thickness of the striking plate 120. When the thickness of the striking plate 120 is less than 1.8 mm, the characteristic time thereof can still be less than 239 micro-seconds. Therefore, the golf club head 100 with the thermoplastic elastic vibration-absorbing material 130 can reduce the thickness of the striking plate 120 and enhance the vibration-absorbing effect thereof.

When hitting a golf ball with the golf club head 100, the golf ball comes into contact with the striking plate 120, which results in the maximum deformation of the striking plate 120, and leaves the striking plate 120. When hitting of the golf ball, the striking plate 120 deforms rearward and creates a stress pressing against the thermoplastic elastic vibration-absorbing material 130 resulting in continuous compression of the thermoplastic elastic vibration-absorbing material 130. At this time, the thermoplastic elastic vibration-absorbing material 130 can allow the striking plate 120 to deform and absorb the vibration of the golf club head 100, thereby enhancing the vibration-absorbing effect.

Further, the thermoplastic elastic vibration-absorbing material 130 can provide the striking plate 120 with a supporting strength. For example, when the golf club head 100 is tested by a golf ball hitting with the velocity of 50 m/s, in comparison with the conventional striking plate, the striking plate 120 of the golf club head 100 is allowed to be thinner, but is not damaged.

TABLE 1

| Volume compression ratio of TPE | Thickness of the striking plate | |
|---|---|---|
| | 174ph | Maraging350 |
| 1% | 2.25 | 1.76 |
| 2% | 2.18 | 1.71 |
| 3% | 2.12 | 1.66 |
| 4% | 2.05 | 1.60 |

TABLE 1-continued

| Volume compression ratio of TPE | Thickness of the striking plate 174ph | Thickness of the striking plate Maraging350 |
|---|---|---|
| 5% | 1.92 | 1.50 |
| 6% | 1.69 | 1.33 |
| 7% | 0.97 | 0.76 |
| Golf club head without TPE | 2.30 | 1.80 |
| Tensile strength | 100 kg/mm | 240 kg/mm |

Referring to Table 1, Table 1 shows the relationship between the golf club head with and without TPE. When the golf club head 100 of the present embodiment has the thermoplastic elastic vibration-absorbing material 130 (such as TPE), and the volume compression ratio thereof is 7%, taking the striking plate made of 174ph stainless steel (the tensile strength is 100 kg/mm) for example, in comparison with the conventional golf club head without TPE, the thickness of the golf club head 100 is 0.97 mm, and the thickness of the conventional golf club head is 2.3 mm. Further, taking the striking plate made of Maraging350 (the tensile strength is 240 kg/mm) for example, the thickness of the golf club head 100 is 0.76 mm, and the thickness of the conventional golf club head is 1.8 mm.

Therefore, the golf club head 100 of the present embodiment can improve the vibration-absorbing effect thereof, enhance a comfortable condition in user's hand when striking and raise the using life time thereof. Further, the thickness of the striking plate 120 can be allowed to reduced, thereby reducing the material used and the weight thereof.

Figure 5A:
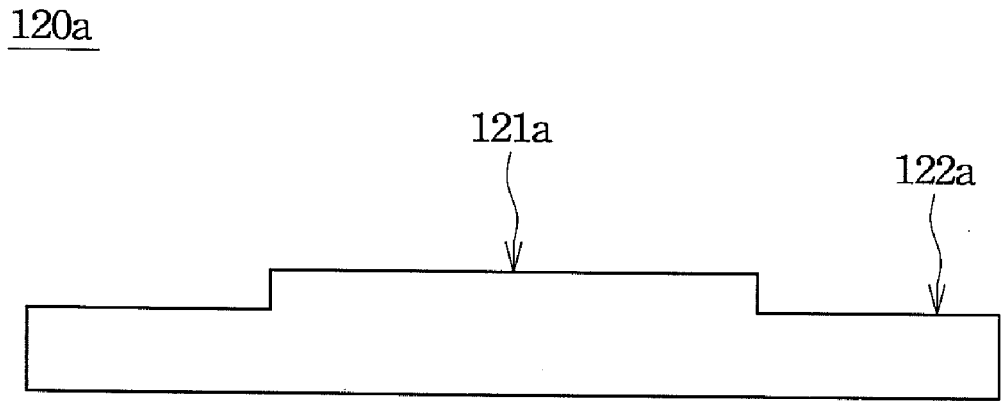
FIG. 5A and FIG. 5B are cross-sectional diagrams showing a golf club head according to a second embodiment of the present invention.
Figure 5B:
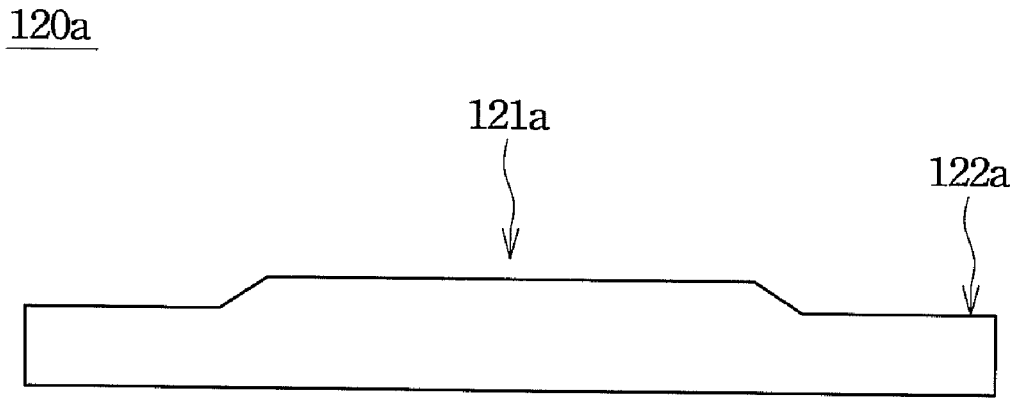

Refer to FIG. 5A and FIG. 5B. FIG. 5A and FIG. 5B are cross-sectional diagrams showing a golf club head according to a second embodiment of the present invention. Some reference numerals shown in the first embodiment are used in the second embodiment of the present invention. The construction shown in the second embodiment is similar to that in the first embodiment with respect to configuration and function, and thus is not stated in detail herein.

Refer again to FIG. 5A and FIG. 5B, in comparison with the first embodiment, the thickness of the striking plate 120*a* of the golf club head 100 of the second embodiment is not uniform. At this time, the thickness (such as 1.6 mm) in the middle area 121*a* (such as the main striking area) of the striking plate 120*a* is greater than the thickness (such as 1.0 mm) in the peripheral area 122*a* thereof, thereby carrying more striking impact, improving the vibration-absorbing effect thereof and reducing the whole thickness thereof. It is worth mentioning that the thickness variation of the striking plate 120*a* may be a ladder type variation (such as FIG. 5A) or a gradual type variation (such as FIG. 5B).

Figure 6A:
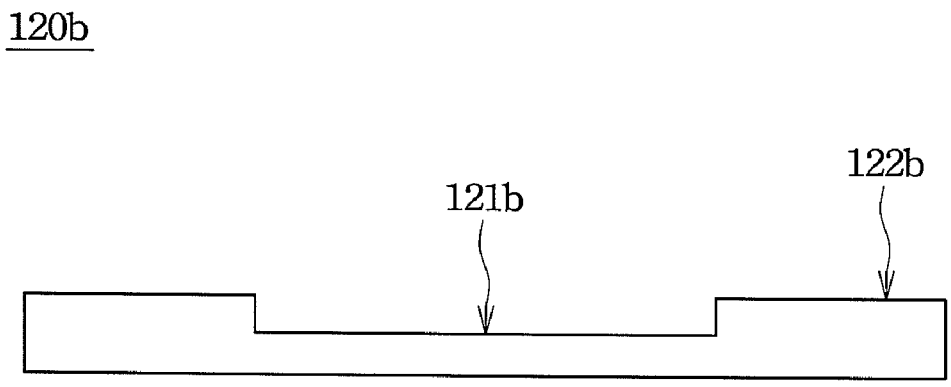
FIG. 6A and FIG. 6B are cross-sectional diagrams showing a golf club head according to a third embodiment of the present invention.
Figure 6B:
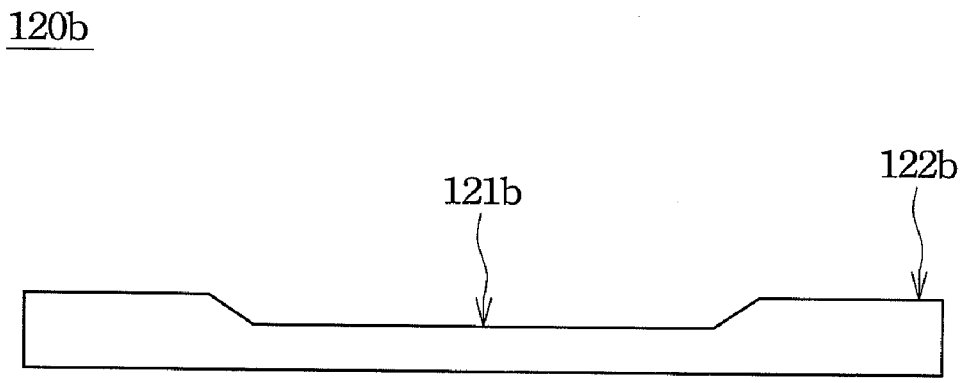

Refer to FIG. 6A and FIG. 6B. FIG. 6A and FIG. 6B are cross-sectional diagrams showing a golf club head according to a third embodiment of the present invention. Some reference numerals shown in the first embodiment are used in the third embodiment of the present invention. The construction shown in the third embodiment is similar to that in the first embodiment with respect to configuration and function, and thus is not stated in detail herein.

Refer again to FIG. 6A and FIG. 6B, in comparison with the first embodiment, the thickness of the striking plate 120*b* of the golf club head 100 of the third embodiment is not uniform. At this time, the thickness in the middle area 121*b* of the striking plate 120*b* is less than the thickness in the peripheral area 122*b* thereof. It is worth mentioning that the thickness variation of the striking plate 120*b* may be a ladder type variation (such as FIG. 6A) or a gradual type variation (such as FIG. 6B).

Figure 7:
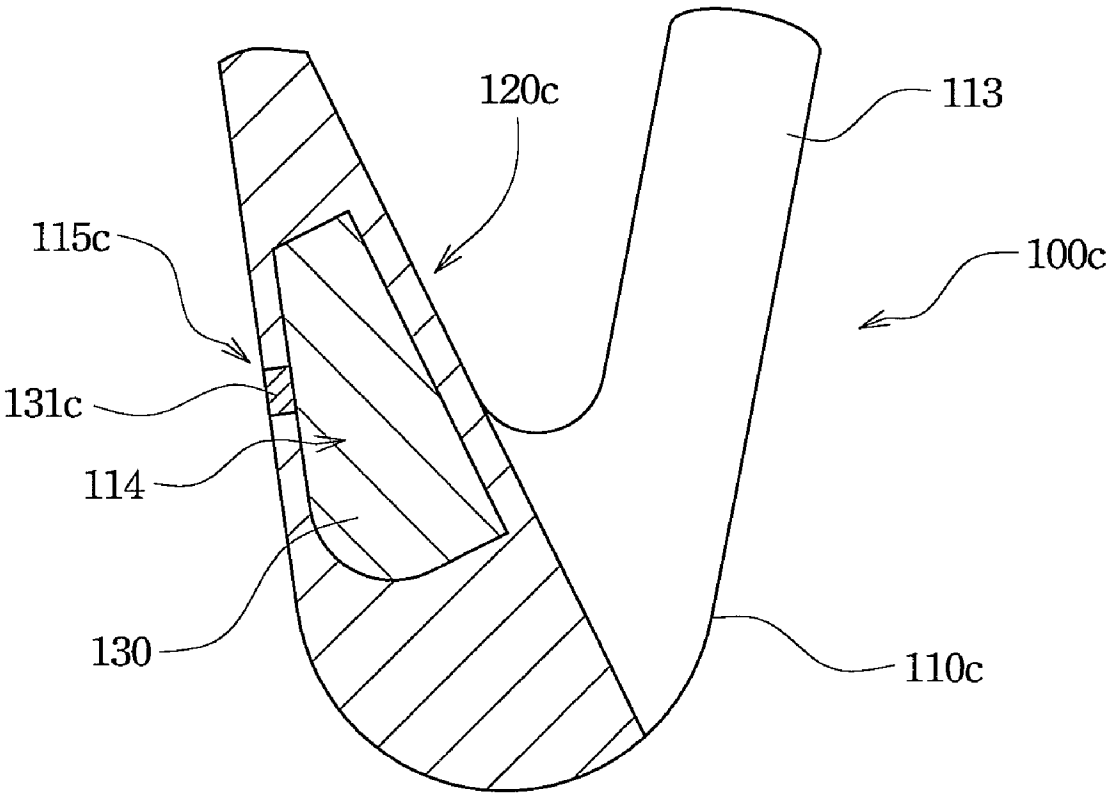
FIG. 7 is a cross-sectional diagram showing a golf club head according to a fourth embodiment of the present invention.

Refer to FIG. 7. FIG. 7 is a cross-sectional diagram showing a golf club head according to a fourth embodiment of the present invention. Some reference numerals shown in the first embodiment are used in the fourth embodiment of the present invention. The construction shown in the fourth embodiment is similar to that in the first embodiment with respect to configuration and function, and thus is not stated in detail herein.

Refer again to FIG. 7, in comparison with the first embodiment, the striking plate 120*c* of the golf club head 100*c* of the forth embodiment can be formed as one piece together with the main body 110*c*. At this time, the injection hole 115*c* may be formed at the rear side of the main body 110*c* to inject the thermoplastic elastic vibration-absorbing material 130, and the sealing element 131*c* seals the injection hole 115C, thereby forming the golf club head 100*c*.

Therefore, the golf club head with the thermoplastic elastic vibration-absorbing material can improve the vibration-absorbing effect thereof and reduce the thickness of the striking plate to reduce the material used and the weight thereof.

As is understood by a person skilled in the art, the foregoing embodiments of the present invention are strengths of the present invention rather than limiting of the present invention. It is intended to cover various modifications and similar arrangements included within the spirit and scope of the appended claims, the scope of which should be accorded the broadest interpretation so as to encompass all such modifications and similar structure.

What is claimed is:

1. A golf club head, comprising:

a main body including a chamber;

a striking plate disposed on the front side of the main body, wherein the chamber is connected to the rear side of the striking plate, and the thickness of the striking plate is substantially between 0.76 mm and 2.25 mm; and a thermoplastic elastic vibration-absorbing material formed in the chamber of the main body and touching the rear side of the striking plate, wherein the density of the thermoplastic elastic vibration-absorbing material is substantially between 0.5 g/cm$^3$ and 1.3 g/cm$^3$;

wherein the characteristic time of the golf club head is substantially less than 257 micro-seconds.

2. The golf club head as claimed in claim 1, wherein the main body further includes an injection hole connected to the chamber to inject the thermoplastic elastic vibration-absorbing material.

3. The golf club head as claimed in claim 1, wherein the thermoplastic elastic vibration-absorbing material is SIS, SBS, SEBS, TPE, TPR, TPU, TPV, TPO or TPEE.

4. The golf club head as claimed in claim 1, wherein the flexural modulus of the thermoplastic elastic vibration-absorbing material is substantially between 2.07 MPa and 339 MPa.

5. The golf club head as claimed in claim 1, wherein the tensile strength of the thermoplastic elastic vibration-absorbing material is substantially between 0.17 MPa and 52.7 MPa.

6. The golf club head as claimed in claim 1, wherein the tensile elongation of the thermoplastic elastic vibration-absorbing material is substantially between 2.9% and 810%.

7. The golf club head as claimed in claim 1, wherein the volume compression ratio of the thermoplastic elastic vibration-absorbing material is substantially less than 7%.

8. The golf club head as claimed in claim 7, wherein the volume compression ratio of the thermoplastic elastic vibration-absorbing material is substantially between 3.5% and 7%.

9. The golf club head as claimed in claim 1, wherein the thickness of the striking plate is uniform.

10. The golf club head as claimed in claim 1, wherein the thickness of the striking plate is not uniform.

11. The golf club head as claimed in claim 10, wherein the thickness in the middle area of the striking plate is greater than the thickness in the peripheral area thereof.

12. The golf club head as claimed in claim 10, wherein the thickness in the middle area of the striking plate is less than the thickness in the peripheral area thereof.

13. The golf club head as claimed in claim 10, wherein the thickness variation of the striking plate is a ladder type variation.

14. The golf club head as claimed in claim 10, wherein the thickness variation of the striking plate is a gradual type variation.

15. The golf club head as claimed in claim 1, wherein the material of the main body is selected from a group consisting of carbon steel, stainless steel, alloy steel, Fe—Mn—Al alloy, Ni-based alloy, cast iron, titanium alloy, aluminum alloy, Al—Mg alloy, tungsten alloy, copper alloy, ceramics, carbon fiber, plastics or any composition thereof.

16. The golf club head as claimed in claim 1, wherein the material of the striking plate is selected from a group consisting of carbon steel, stainless steel, Fe—Mn—Al alloy, titanium alloy, aluminum alloy, copper alloy, ceramics, carbon fiber, plastics or any composition thereof.

17. The golf club head as claimed in claim 1, wherein the relationship between the thickness of the striking plate and the characteristic time of the golf club head is expressed as:

$$y<-204.58x+712.88$$

wherein x and y are respectively the thickness of the striking plate and the characteristic time of the golf club head.

18. The golf club head as claimed in claim 1, wherein the striking plate is formed as one piece together with the main body.

19. A golf club head, comprising:

a main body including a chamber and an injection hole;

a striking plate disposed on the front side of the main body, wherein the chamber is connected to the rear side of the striking plate, and the thickness of the striking plate is substantially between 0.76 mm and 2.25 mm; and a thermoplastic elastic vibration-absorbing material formed in the chamber, injected through the injection hole and touching the rear side of the striking plate, wherein the density of the thermoplastic elastic vibration-absorbing material is substantially between 0.5 $g/cm^3$ and 1.3 $g/cm^3$;

wherein the characteristic time of the golf club head is substantially less than 239 micro-seconds.

20. The golf club head as claimed in claim 19, wherein the thermoplastic elastic vibration-absorbing material is SIS, SBS, SEBS, TPE, TPR, TPU, TPV, TPO or TPEE.

* * * * *